United States Patent [19]

Sorenson

[11] Patent Number: 4,744,873

[45] Date of Patent: May 17, 1988

[54] MULTIPLE COMPARTMENT ELECTROLYTIC CELL

[75] Inventor: Marius W. Sorenson, Lake Jackson, Tex.

[73] Assignee: The Dow Chemical Company, Midland, Mich.

[21] Appl. No.: 934,769

[22] Filed: Nov. 25, 1986

[51] Int. Cl.[4] ..... C25B 1/16; C25B 1/34; C25B 11/03; C25B 15/08

[52] U.S. Cl. ..... 204/98; 204/128; 204/265; 204/266; 204/277; 204/278; 204/284

[58] Field of Search ..... 204/284, 277, 278, 265, 204/266, 128, 98, 256, 258; 429/38–40

[56] References Cited

U.S. PATENT DOCUMENTS

| | | | |
|---|---|---|---|
| 1,474,594 | 11/1923 | Keeler | 204/1 T |
| 1,790,248 | 1/1931 | Roth | 204/284 |
| 2,273,795 | 2/1942 | Heise et al. | 204/98 |
| 2,681,887 | 6/1954 | Butler, Jr. | 204/265 X |
| 2,688,884 | 9/1954 | Warmoes et al. | 74/470 |
| 2,848,402 | 8/1958 | De Haas Van Dorsser et al. | 204/151 |
| 3,035,998 | 5/1962 | Sommer et al. | 204/284 |
| 3,117,034 | 1/1964 | Tirrell | 136/86 |
| 3,117,066 | 1/1964 | Juda | 204/128 |
| 3,124,520 | 3/1964 | Juda | 204/86 |
| 3,262,868 | 7/1966 | Juda | 204/98 |
| 3,276,911 | 10/1966 | Schoeneweis | 136/120 |
| 3,316,167 | 4/1967 | Clarke, Jr. et al. | 204/268 |
| 3,377,265 | 4/1968 | Caesar | 204/290 |
| 3,507,701 | 4/1970 | Broyde | 136/86 |
| 3,527,690 | 9/1970 | Bellay et al. | 204/277 X |
| 3,544,378 | 12/1970 | Broyde | 136/86 |
| 3,645,796 | 2/1972 | Bohm et al. | 136/86 D |
| 3,660,225 | 5/1972 | Verreyne et al. | 162/17 |
| 3,711,388 | 1/1973 | Gritzner | 204/128 |
| 3,711,396 | 1/1973 | Ashe, Jr. et al. | 204/284 |
| 3,767,542 | 10/1973 | Carlson | 204/98 |
| 3,804,739 | 4/1974 | Bergeron | 204/266 |
| 3,864,236 | 2/1975 | Lindstrom | 204/265 |
| 3,923,628 | 12/1975 | Gritzner | 204/237 |
| 3,926,769 | 12/1975 | Gritzner | 204/237 |
| 3,935,027 | 1/1976 | Warde et al. | 136/86 A |
| 3,959,112 | 5/1976 | Arend, Jr. | 204/273 |
| 3,984,303 | 10/1976 | Peters et al. | 204/260 |
| 4,035,253 | 7/1977 | Jones et al. | 204/78 |
| 4,035,254 | 7/1977 | Gritzner | 204/98 |
| 4,035,255 | 7/1977 | Gritzner | 204/98 |
| 4,178,350 | 12/1979 | Collins et al. | 423/248 |
| 4,213,833 | 7/1980 | Lefevre | 204/98 |

(List continued on next page.)

FOREIGN PATENT DOCUMENTS 0107612 5/1984 European Pat. Off. .

OTHER PUBLICATIONS

"An Electrochemically Regenerative Hydrogen–Chlorine Energy Storage System", *J. Electrochem. Soc.: Electrochemical Science and Technology*, D. T. Chin, R. S. Yeo, J. McBreen and S. Srinivasan, vol. 126, No. 5, May 1979, pp. 713–720.

*Primary Examiner*—Donald R. Valentine

[57] ABSTRACT

The invention is an electrode/gas chamber combination comprising:

a gas-permeable, vertically disposed electrode having oppositely disposed first and second vertical surfaces;

a gas supply chamber in fluid and electrical contact with the electrode at a plurality of points, said gas supply chamber having a plurality of compartments, at least including a gas inlet compartment, an intermediate compartment, and a gas outlet compartment, each of said compartments being connected to its adjoining compartments through a fluid permeable structure, and wherein at least a portion of some of said compartments open onto portions of a first surface of the electrode thereby providing a pathway for a gas to contact the first surface of the electrode; and wherein at least a portion of the walls of the gas supply chamber are electrically conductive to provide a pathway for electrical current to flow from a power supply to the electrode.

10 Claims, 1 Drawing Sheet

U.S. PATENT DOCUMENTS

| | | | |
|---|---|---|---|
| 4,224,129 | 9/1980 | McIntyre et al. | 204/263 |
| 4,256,545 | 3/1981 | Deborski | 204/290 R |
| 4,257,867 | 3/1981 | Hammond | 204/265 |
| 4,260,469 | 4/1981 | McIntyre et al. | 204/265 |
| 4,269,691 | 5/1981 | Deborski | 204/290 R |
| 4,312,720 | 1/1982 | Lefevre | 204/78 |
| 4,317,704 | 3/1982 | McIntyre et al. | 204/1 R |
| 4,341,606 | 7/1982 | McIntyre et al. | 204/98 |
| 4,376,691 | 3/1983 | Lindstrom | 204/265 |
| 4,389,289 | 6/1983 | deNora | 204/128 |
| 4,406,758 | 9/1983 | McIntyre et al. | 204/98 |
| 4,415,424 | 11/1983 | Pere | 204/257 |
| 4,447,322 | 5/1984 | Zajdlik | 210/104 |
| 4,537,673 | 8/1985 | Asawa et al. | 204/253 |
| 4,657,651 | 4/1987 | Wainerdi | 204/266 X |

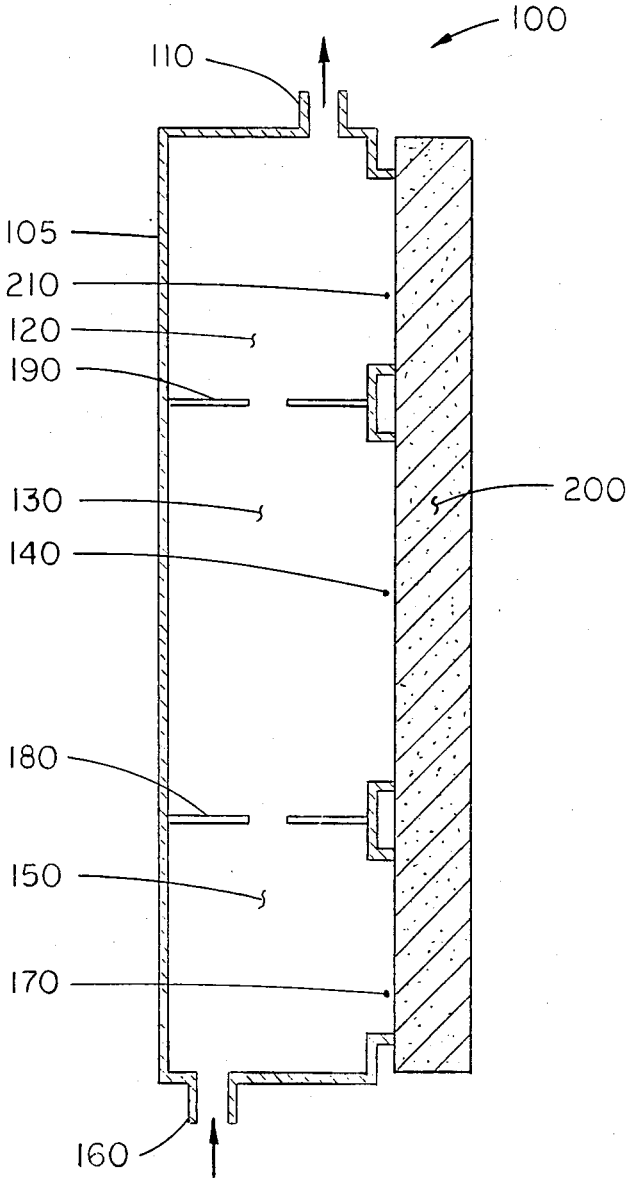
100
110
105
210
120
190
130
140
200
180
150
170
160

MULTIPLE COMPARTMENT ELECTROLYTIC CELL

BACKGROUND OF THE INVENTION

Gas electrodes in which a gas is contacted with an electrode in the presence of an electrolyte solution for electrolysis are well known. In their typical uses, gas electrodes function in systems capable of generating electricity (such as fuel cells and the like) or for electrolysis purposes in which the electrode performs as a depolarized electrode (as in chlor-alkali and the like). Gas electrode installations implement electrochemical reactions involving the interaction with, and between, three reactants: (1) a gas; (2) a liquid (usually aqueous) electrolyte; and (3) electrons, all of which require simultaneous contact in order to accomplish a desired reaction.

Depolarized electrodes generally have two oppositely disposed vertical faces. One of the faces is adapted to contact a liquid electrolyte, while the other face is adapted to contact a gas. During operation of the cell, the liquid permeates into the interstices of the electrode from one side, while the gas permeates into the interstices of the electrode from the other side. Inside the electrode, there is formed a three phase contact between the liquid electrolyte, the gas, and the solid electrode body. Electrical energy is transferred into the electrode and electrolytic reactions occur. Such electrical reactions could be electrolysis reactions to produce products such a chlorine, hydrogen chloride, or caustic. Optionally, such reactions could be conducted to produce electrical energy (as in a fuel cell or a battery) rather than consume electrical energy.

Oxygen depolarized electrodes are of special interest in commercial, large scale chlor-alkali operations and analogous electrolyzers of other alkali metal or acid halides. In the electrolysis of common salt brine, for example, the reaction at the depolarized cathodic oxygen electrode in the alkaline media of the catholyte is:

$$O_2+2H_2O+4e^- \rightarrow 4OH^- \text{ with } E^\circ=+0.401 \text{ volts}$$

In comparison, the cathode reaction in a traditionally conventional chlor-alkali cell is:

$$2H_2O+2e^- \rightarrow H_2+2OH^- \text{ with } E^\circ=-0.828 \text{ volts}$$

Thus, the use of an oxygen depolarized cathode for chlor-alkali electrolytic cells brings about a theoretically achievable electrical potential requirement saving of 1.229 volts. This, for practical purposes, translates to the possibility of very substantial reduction in and economizing of power costs, when compared with the non-depolarized chlor-alkali cells.

Depolarized electrodes can also function as depolarized anodes. Depolarized anodes have a hydrogen-containing gas contacting one side of the anode and an electrolyte contacting another side. In the case of chlor-alkali cells, hydrogen gas may be contacted with one side of the anode and a sodium chloride brine solution contacted with another side of the anode to produce hydrogen chloride.

Although such electrodes are theoretically very useful, there are certain considerable difficulties involved in their use in large-scale commercial manufacturing purposes (as in the chlor-alkali trade). Three major problems include: the leaking of gas or electrolyte across the gas-permeable electrode; the difficulty of distributing the electrical current relatively evenly to all the active surface of the electrode; and the difficulty of supporting such electrodes to prevent their rupture.

A significant and perplexing problem is the frequent occurrence of the passage of reactant gas through the electrode and into the electrolyte in tall cell assemblies. In many commercial installations, the electrolyte is often contained in contact with the electrode in considerable depth (frequently as deep as 4–6 feet, or deeper). With a liquid hydraulic pressure of such magnitude, the catholyte exerts a substantial hydraulic pressure on the face of the electrode. If the gas pressure is reduced to avoid bubbling in the upper portions of the electrode, the increasingly pressurized liquid towards the lower electrode portions overcomes the restraint of the applied gas and leaks into the gas chamber. This often tends to render inoperable, or at least considerably diminish, the effectiveness and productive capacity of the cell. Leaking of gas or electrolyte through the electrode is, therefore, extremely undesirable. Not only does it tend to materially interfere with and diminish overall reaction efficacy, it occasions, among other things, escape of reaction gas which is either lost or, if collected, must be handled through recovery and reprocessing units for subsequent reuse. In any event, leaking can increase the cost of the operation. The present invention provides an article which minimizes the leakage of gas and electrolyte through depolarized electrodes.

A second problem encountered with the use of large-scale depolarized electrodes involves the difficulty in obtaining uniform distribution of current to the entire active surface of the electrode without blocking substantial portions of the electrode to the gas. Uniform distribution of current to the electrode requires a large number of electrical connections which, when attached to the electrode, tend to prevent gas from gaining access to the electrode. The present invention provides an article which provides means to assure a somewhat uniform distribution of electrical current to the surface of depolarized electrodes without blocking substantial amounts of gas from entering the electrode, would be highly desirable.

A third, and perhaps even more significant, problem in using large scale depolarized electrodes involves the difficulty in supporting the depolarized electrodes against large liquid hydraulic pressures while not blocking gas from the surface of the electrode. The large liquid hydraulic pressures encountered in tall electrodes frequently require extra support in the lower portions of the vertically disposed electrode to minimize the likelihood of the electrode rupturing. The present invention provides an article which provides the necessary support for tall depolarized electrodes without substantially interfering with the delivery of gas to the surface of the electrode.

SUMMARY OF THE INVENTION

The invention is an electrode/gas chamber combination comprising:

a gas-permeable, vertically disposed electrode having oppositely disposed first and second vertical surfaces;

a gas supply chamber in fluid and electrical contact with the electrode at a plurality of points, said gas supply chamber having a plurality of compartments, at least including a gas inlet compartment, an intermediate compartment, and a gas outlet compartment, each of said compartments being connected to its adjoining compartments through a fluid permeable structure, and wherein at least a portion of some of said compartments open onto portions of a first surface of the electrode thereby providing a pathway for a gas to contact the first surface of the electrode; and wherein at least a portion of the walls of the gas supply chamber are electrically conductive to provide a pathway for electrical current to flow from a power supply to the electrode.

BRIEF DESCRIPTION OF THE DRAWING

The FIGURE shows the electrode/gas chamber combination 100 of the present invention.

DETAILED DESCRIPTION OF THE INVENTION

The electrode/gas chamber combination of the present invention, because of its unique design, provides a large number of advantages over the cells of the prior art which have depolarized electrodes. The gas chamber of the electrode/gas chamber combination of the present invention serves three purposes: (1) providing a pathway for gas to reach the active surfaces of the electrode, thereby assuring the efficient use of the electrode; (2) acting as a current distributor to distribute current from a power supply to the electrode at a plurality of points, thereby assuring relatively uniform current distribution; and (3) acting as a structural support for the electrode at a plurality of points, thereby assuring the electrode is properly supported without substantially blocking the access of gas to the active surfaces of the electrode. This unique design allows the electrode structures of the present invention to be used in cells larger than would have been possible with those of the prior art. Another, significant, benefit of the present structure is the fact that it allows depolarized electrodes to be used in pressurized cells.

The electrode/gas chamber combination of the present invention can be used as depolarized cathodes or depolarized anodes. Likewise, it can be used with electrochemical cells of a wide variety of shapes, sizes, and types. It is especially particularly useful as a concentric, cylindrical shaped electrode, because the cylindrical shape is particularly well suited to withstand high gas pressures.

Depolarized cathodes which are suitable for use as the electrode in the present invention include a variety of styles including porous metal electrodes, carbon/-polytetrafluoroethylene electrodes, beds of particles, etc. Such electrodes are well known in the art and are represented in a variety of U.S. patents including, for example, U.S. Pat. Nos. 4,187,350; 4,213,833; 4,224,129; 4,256,545; 4,260,469; 4,269,691; 4,312,720; 4,317,704., 4,341,606; and 4,406,758; 4,445 896. These patents are incorporated by reference for the purpose of the depolarized cathodes that they teach. Other depolarized cathodes are shown in European patent application No. 0,051,432; European patent application No. 0,051,435; European patent application No. 0,051,437; and European patent application No. 0,051,439.

Depolarized anodes suitable for use as the electrode in the present invention include a variety of styles and types. Suitable anodes are described in, for example, U.S. Pat. Nos. 3,124,520; and 4,447,322. These patents are incorporated by reference for the purpose of the depolarized anodes that they teach. Other depolarized anodes are shown in European patent application Nos. 107,612A and "An Electrochemically Regenerative Hydrogen-Chlorine Energy Storage System", D. T. Chin, R. S. Yeo, J. McBreen, S. Srinivasan, *Journal of Electrochemical Society,* Volume 126, page 713, 1979.

The electrode/gas chamber combination of the present invention may be better understood by reference to the FIGURE. The electrode/gas chamber combination 100 of the present invention is composed of a gas supply chamber 105 and a depolarized electrode 200.

The gas supply chamber is divided into a plurality of compartments each of which opens onto a face of the electrode 200. In actual practice, the gas supply chamber 105 may contain a large number of compartments, however, for the purposes of illustration, only three compartments are discussed: (1) a gas inlet compartment 150, (2) an intermediate compartment 130, and (3) a gas outlet compartment 120.

Electrical energy can be transferred from the gas supply chamber 150 into electrode 200 at a plurality of points including transfer points 115, 125, 125A, 155, 155A, and 165. It should be noted that, theoretically, the greater the number of compartments, the better the operation of the cell, because a large number of compartments provides a large number of contact points to distribute electrical current to the electrode and provides the maximum amount of support to the electrodes. However, the more the compartments, the more "dead spots" are created on the electrode surface where the transfer points contact the electrode. Thus, it is not desirable to have an excessive number of compartments.

The gas inlet compartment 150 has a gas inlet nozzle 160 through which a gas can be introduced into the gas inlet compartment 150. The gas inlet compartment 150 is connected to the intermediate compartment 130 through a first foraminous structure 180. Likewise, intermediate compartment 130 is connected to gas outlet compartment 120 through second foraminous structure 190. A gas outlet nozzle 110 is connected to the gas outlet compartment 120 and provides a pathway for gas to exit the gas supply chamber 105. The gas outlet nozzle 110 is also the orifice for gas supply chamber 105. The foraminous structures serve to restrict the flow of gas from one compartment to its downstream compartment.

Compartment 120 opens onto the electrode 200 at area 210; compartment 130 opens onto electrode 200 at area 140; and compartment 150 opens onto electrode 200 at area 170. These areas provide a pathway for gas to contact the electrode 200 and pass into the interstices thereof for reaction with electrolyte. It is necessary for there to be a sufficient opening from each compartment to the electrode 200 to allow sufficient gas to contact the electrode 200. Preferably, the entire surface of each compartment opens to the electrode 200, thus providing almost the entire surface of the electrode 200 to contact gas.

During operation of the electrode/gas chamber 100, gas is continually flowed through the gas supply chamber 105. However, during its passage through the gas supply chamber 105 a portion of it is consumed in electrolytic reactions that occur inside electrode 200 (discussed later). When air is used as the gas, preferably it is flowed at such a rate as to maintain the concentration of $O_2$ in each compartment relatively constant.

To minimize the bubbling of gas through the upper portions of the electrode 200 and to minimize the leaking of electrolyte through the lower portions of the electrode 200, it is necessary that the flow of gas through the gas supply chamber 105 be restricted at certain locations to provide a high gas pressure in the lower gas compartments, and a lower gas pressure in the upper gas compartments. The lowest compartment must have the highest gas pressure because it has the greatest liquid hydraulic pressure exerted on the portion of the electrode contacting the compartment. The next highest compartment should have a lower gas pressure than the lowest compartment because the liquid hydraulic pressure is not as great on the second compartment as on the lowest compartment. The top compartment should have the lowest gas pressure of any chamber because the liquid hydraulic pressure is at a minimum at the top compartment.

To assure that the compartments have the proper gas pressure, a series of foraminous structures are used to separate the compartments of the gas chamber. As such, a first foraminous structure 180 restricts the flow of gas from gas inlet compartment 150 to intermediate compartment 130. Likewise, a second foraminous structure 190 restricts the flow of gas from intermediate compartment 130 to gas outlet compartment 120. Similarly, gas outlet nozzle 110 restricts the flow of gas from gas outlet compartment 120 to the outside of the gas supply chamber 105.

The particularly advantageous feature about the present inventive structure is the fact that the walls which define each of the gas compartments also act to support the electrode 200 and provide a pathway for electrical current to flow from a power supply to the electrode 200.

The foraminous structures separating the gas compartments may take a variety of forms. For example, each may be an orifice, a fritted material, a valve, a combination thereof, or any other structure that restricts the flow of gas. Preferably, for simplicity, each foraminous structure is an orifice.

Optionally, instead of providing a foraminous structure between each compartment to restrict the flow of gas from one chamber to another chamber, it is equally suitable to fill, or partially fill, each compartment with a gas-permeable material, to restrict the flow of gas through the chamber. For example, the compartments may be packed with fiberglass, plastic pellets, or a large variety of other materials.

If orifices are used to separate the compartments, it is necessary to provide orifices of the proper size. To size orifices separating the compartments of the electrode/gas chamber combination of the present invention, several well known calculations are made. U.S. Pat. No. 4,341,606 "Method of Operating Electrolytic Cells Having Massive Dual Porosity Gas Electrodes" McIntyre, Phillips, and Lefevre, has an excellent discussion about such calculations including calculations for determining gas pressures, capillary pressures, and liquid hydraulic pressures. That patent is hereby incorporated by reference for the purposes of such calculations. The electrode/gas chamber combination of the present invention is designed so that the gas pressure in each compartment is at least equal to the sum of: (1) the liquid hydraulic pressure exerted by electrolyte on the opposing surface of the electrode, (2) the capillary pressure exerted by the capillaries of the electrode, and (3) the pressure under which the cell is operated. This is represented by the formula:

$$P(gas)=P(hydraulic)+P(capillary)+P(cell)$$

where

P(hydraulic) is the liquid hydraulic pressure exerted by the electrolyte on the surface of the electrode opposing the gas compartment, centimeters mercury pressure.

P(capillary) is the resistance to flow offered by the capillaries of the electrode, centimeters mercury pressure.

P(cell) is the pressure under which the cell is operated, centimeters mercury pressure.

The P(hydraulic) may be calculated by the following formula:

$$P(hydraulic)=(h)*(d)*(g)*(0.00007501)$$

where

P(hydraulic) is the liquid hydraulic pressure exerted by the electrolyte on the surface of the electrode opposing the gas compartment, centimeters mercury pressure h is the height of the liquid exerting the liquid hydraulic pressure, centimeters d is the density of the liquid, grams/cubic centimeter g is a gravitational constant, centimeter/sec$^2$ 0.00007501 is a conversion factor to convert dynes/square centimeter to centimeters mercury pressure.

The P(capillary) may be calculated using the following formula:

$$P(capillary)=(2)*(S)*(\cos\Theta)*(0.00007501)/(r)$$

where

P(capillary) is the resistance to flow offered by the passageways of the electrode, centimeters mercury pressure S is the liquid surface tension, dynes/centimeter $\Theta$ is the contact angle of the liquid on the electrode 0.00007501 is a conversion factor to convert dynes/square centimeter to centimeters mercury pressure r is the radius, in cm, of one of the capillaries in the electrode The cross-sectional area of an orifice between two gas compartments may be calculated using the following formula:

$$X=[(2)*(g)*(13.6)*(\alpha)/(d)]^{0.5};$$

followed by $$A=(q)*(100)/[(X)*(Y)*(C)]$$

where

A is the cross-sectional area of the orifice, square mm q is the flow rate of the gas, cubic cm/sec.

Y is an expansion factor of about 1

C is a flow coefficient factor of about 0.4 g is the gravitational constant of 980.665 cm/second$^2$ $\alpha$ (cm mercury) is the pressure drop from one compartment to its adjoining, downstream compartment 13.6 is factor to convert cm mercury pressure to gm/cm$^2$ pressure d is the density of the gas, gm per cubic centimeter.

Finally, the diameter of the orifice may be calculated using the following formula:

$$Diameter=[(4)*(A)/3.14)]^{0.5}$$

where A is the cross-sectional area of the orifice, mm.

A detailed calculation using the above formulas is illustrated in Example 1.

EXAMPLE 1

This example shows how to calculate the diameter of the orifices separating each of the cell compartments in a cell having the following characteristics:

Cell height=182.88 cm
Diameter of the gas compartment=6.35 cm
Entire surface area of the electrode contacting the electrolyte=3646.44 square cm
Catholyte caustic strength=35 weight % NaOH
Density of catholyte=1.34 grams/cubic centimeter
Catholyte surface tension=89 dynes/centimeter
Cell pressure=76 centimeters mercury
Cell Temperature=95° Centigrade
Current density=31 amps per square decimeter of electrode surface
Cathode amps=1130.4 amps
Number of chambers in the cathode=10
Height/chamber=18.288 cm
Amps/chamber=113.04 amps
Oxygen consumed/chamber of cathode=396 cubic centimeters of oxygen /minute, at standard temperature and pressure
Total oxygen consumed=3960 cubic centimeters oxygen per minute, at standard temperature and pressure.
Oxygen was flowed through the cathode at twice the stoichiometric rate and at a rate of 7920 cubic centimeters per minute.
The contact angle of catholyte in the pores is assumed to be 0°.

The liquid hydraulic pressure in a given liquid bath at any given normal or reasonable operating temperature is expressed by the formula:

$$P(\text{hydraulic})=h * g * d * 0.00007501$$

wherein

P(hydraulic) is the liquid hydraulic pressure in centimeters mercury pressure
h is height in centimeters
d is the density of the liquid in grams/cm$^3$
g is a gravitational constant equalling 980.665 cm/sec$^2$
0.00007501 is a conversion factor to convert dynes/cm$^2$ to centimeters mercury pressure Inserting the values (h=182.88 cm; g=980.665 cm/sec$^2$; d=1.34 grams/ cm$^3$) into the formula, one obtains:

$$P(\text{hydraulic})=182.88 * 1.34 * 980.665 * 0.00007501=18.024 \text{ centimeters mercury pressure}$$

The capillary pressure of the pore is expressed by the formula:

$$P(\text{cap})=2 * S * \cos \Theta * 0.00007501/r$$

wherein

P(cap) is the pressure in cm mercury pressure
S is the liquid surface tension in dynes/cm
Θ is the contact angle
0.00007501 is a conversion factor to convert dynes/cm$^2$ to centimeters mercury pressure
r is pore size in cm.

Substituting the following values (S=89; A=0°; r=0.0005 cm) into the equation, one obtains:

$$P(\text{cap})=(2 * 89 * \cos 0 * 0.00007501)/(0.0005)=26.70 \text{ centimeters mercury pressure}$$

Note that P(cap) remains constant at 26.70 centimeters mercury pressure throughout the height of the electrode.

The cell of the present example is assumed to operate under atmospheric pressure, thus P(cell)=76 cm mercury pressure.

Substituting values into the equation:

$$P(\text{gas})=P(\text{hydraulic})+P(\text{cap})+P(\text{cell})$$

one obtains:

$$P(gas)=18.02+26.70+76=120.72 \text{ cm mercury pressure}$$

Many other more complex and more accurate equations can be used to calculate the area needed. However, to compute the cross-sectional area of the orifice which separates each of the compartments, the following equation can be used.

$$A=(q * 100) / (Y * C * (2 * g * 13.6 * \alpha/d)^{0.5})$$

wherein:

A=Cross section area of orifice in square mm
q=Flow rate in cubic cm/second
Y=1, an expansion factor
C=0.4, a flow coefficient factor
g=980.665 cm/sec$^2$
α=pressure drop, cm mercury pressure
d=gas density in gm/cm$^3$
13.6=factor to convert cc mercury pressure to gm/cm$^2$ pressure The following equation will compute the orifice diameter of the holes between chambers.

$$D=((4 * A'') / 3.14)^{0.5}$$

wherein:

D=orifice diameter in mm
A''=area orifice in square mm

The results of the calculations are shown in the following table.

(Note $O_2$ flow means the flow leaving the chamber. Liquid hydraulic pressure is the average liquid hydraulic pressure exerted by the electrolyte. Chamber 1 is the bottom chamber and chamber 10 is the top chamber.) Note that P(gas) is equal to the sum of P(atm)+P(hydraulic)+P(cap), where P(atm) is 76 cm mercury pressure. Also note that P(hydraulic) is calculated at ½ height in each chamber.

| Chamber Number | Pressure in cm Mercury P (hydraulic) | P (cap) | P (gas) | $O_2$ Flow (cc/min) | Orifice Diameter (mm) |
|---|---|---|---|---|---|
| 10 | 0.90 | 26.70 | 103.60 | 3960 | 0.959 |
| 9 | 2.70 | 26.70 | 105.41 | 4356 | 1.982 |
| 8 | 4.51 | 26.70 | 107.21 | 4752 | 2.061 |
| 7 | 6.31 | 26.70 | 109.01 | 5148 | 2.136 |
| 6 | 8.11 | 26.70 | 110.82 | 5544 | 2.208 |
| 5 | 9.91 | 26.70 | 112.62 | 5940 | 2.276 |
| 4 | 11.72 | 26.70 | 114.42 | 6336 | 2.342 |
| 3 | 13.52 | 26.70 | 116.22 | 6732 | 2.404 |
| 2 | 15.32 | 26.70 | 118.03 | 7128 | 2.465 |
| 1 | 17.13 | 26.70 | 119.83 | 7524 | 2.522 |

I claim:

1. An electrode/gas chamber combination comprising:

a gas-permeable, vertically disposed electrode having oppositely disposed first and second vertical surfaces;

a gas supply chamber in fluid and electrical contact with the electrode at a plurality of points, said gas supply chamber having a plurality of compartments, at least including a gas inlet compartment, an intermediate compartment, and a gas outlet compartment, each of said compartments being connected to its adjoining compartments through a fluid permeable structure, and wherein at least a portion of some of said compartments open onto portions of a first surface of the electrode thereby providing a pathway for a gas to contact the first surface of the electrode; and wherein at least a portion of the walls of the gas supply chamber are electrically conductive to provide a pathway for electrical current to flow from a power supply to the electrode.

2. The combination of claim 1 wherein said gas supply chamber has a plurality of intermediate compartments.

3. The combination of claim 1 wherein the fluid permeable structure connecting adjoining compartments is a fritted structure.

4. The combination of claim 1 wherein the fluid permeable structure connecting adjoining compartments is an orifice.

5. An electrochemical cell having an anode and a cathode separated by a separator, wherein the cathode is an electrode/gas chamber combination comprising:

a gas-permeable, vertically disposed electrode having oppositely disposed first and second vertical surfaces;

a gas supply chamber contacting and supporting the electrode;

wherein said gas supply chamber has a plurality of compartments at least including a gas inlet compartment, an intermediate compartment, and a gas outlet compartment;

each of said compartments being connected to its adjoining compartments through a foraminous structure and at least a portion of said compartments opening onto portions of the first surface of the electrode to provide a pathway for gas to reach the surface of the electrode;

wherein at least a portion of the walls of the gas supply chamber are electrically conductive and provide a pathway for electrical current to flow from a power supply to the electrode.

6. The cell of claim 5 including a means for flowing an oxygen containing gas into the gas supply chamber.

7. An electrolysis method employing a cell having an anode and a cathode separated by an ion exchange membrane wherein the cathode is an electrode/gas chamber combination having:

a gas-permeable, vertically disposed electrode having oppositely disposed first and second vertical surfaces;

a gas supply chamber contacting and supporting the electrode;

wherein said gas supply chamber has a plurality of compartments at least including a gas inlet comparatment, an intermediate compartment, and a gas outlet compartment;

each of said compartments being connected to its adjoining compartments through a foraminous structure and at least a portion of said compartments opening onto portions of the first surface of the electrode to provide a pathway for gas to reach the surface of the electrode;

wherein at least a portion of the walls of the gas supply chamber are electrically conductive and provide a pathway for electrical current to flow from a power supply to the electrode;

said method comprising:

flowing an aqueous alkali metal halide solution into a compartment containing the anode;

flowing an oxygen gas into the gas supply chamber of said cathode; and electrolyzing said aqueous alkali metal halide solution to form a halide gas at said anode and an alkali metal hydroxide at said cathode.

8. The method of claim 7 wherein the alkali metal halide is sodium chloride.

9. The method of claim 7 wherein the alkali metal hydroxide is sodium hydroxide.

10. An electrode/gas chamber combination comprising:

a gas-permeable, vertically disposed electrode having oppositely disposed first and second vertical surfaces;

a gas supply chamber having metallic walls and being in fluid and electrical contact with the electrode at a plurality of points, said gas supply chamber having a plurality of compartments, at least including a gas inlet compartment, an intermediate compartment, and a gas outlet compartment, each of said compartments being connected to it adjoining compartments through a fluid permeable structure, and wherein at least a portion of some of said compartments open onto portions of a first surface of the electrode thereby providing a pathway for a gas to contact the first surface of the electrode; and wherein at least a portion of the walls of the gas supply chamber are electrically conductive to provide a pathway for electrical current to flow from a power supply to the electrode.

* * * * *

UNITED STATES PATENT AND TRADEMARK OFFICE

CERTIFICATE OF CORRECTION

PATENT NO. : 4,744,873

DATED : May 17, 1988

INVENTOR(S) : Marius W. Sorenson

It is certified that error appears in the above-identified patent and that said Letters Patent is hereby corrected as shown below:

The drawing which appears on pages 1 and 2 of the above-identified patent should be deleted to appear as per attached sheet.

Column 3, line 55; delete "." after "4,317,704" and insert therefor --;--.

Column 3, line 56; change "4,445 896" to --4,445,896--.

Column 10, line 10, Claim 7; change "paratment" to --partment--.

Column 10, line 48, Claim 10; change "it" to --its--.

UNITED STATES PATENT OFFICE

CERTIFICATE OF CORRECTION

PATENT NO. : 4,744,873

DATED : May 17, 1988

INVENTOR(S) : Marius W. Sorenson

It is certified that error appears in the above-identified patent and that said Letters Patent are hereby corrected as shown below:

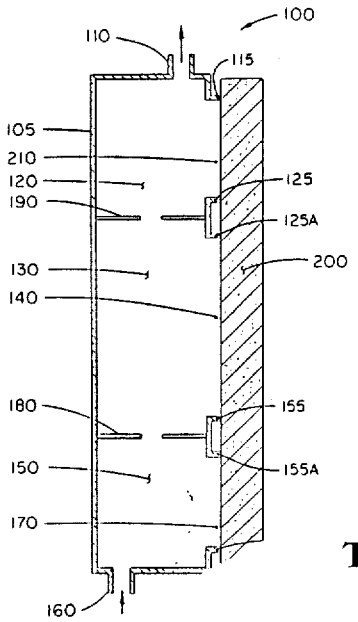

Signed and Sealed this

Tenth Day of January, 1989

*Attest:*

DONALD J. QUIGG

*Attesting Officer*

*Commissioner of Patents and Trademarks*